United States Patent [19]

Memmen

[11] Patent Number: 4,542,867

[45] Date of Patent: Sep. 24, 1985

[54] INTERNALLY COOLED HOLLOW AIRFOIL

[75] Inventor: Robert L. Memmen, Juno Isles, Fla.

[73] Assignee: United Technologies Corporation, Hartford, Conn.

[21] Appl. No.: 462,496

[22] Filed: Jan. 31, 1983

[51] Int. Cl.[4] ..... B64C 3/36

[52] U.S. Cl. ..... 244/117 A; 416/97 A; 416/90 R

[58] Field of Search ..... 244/35 A, 35 R, 123, 244/117 A, 207–209; 416/90, 97 R, 97 A, 232, 233; 29/156.8 H, 156.8 FC

[56] References Cited

U.S. PATENT DOCUMENTS

| | | | |
|---|---|---|---|
| 2,879,028 | 3/1959 | Stalker | 416/90 |
| 2,923,525 | 2/1960 | Creek | 416/233 |
| 3,628,880 | 12/1971 | Smuland | 416/97 R |
| 4,025,226 | 5/1977 | Hovan | 416/97 A |
| 4,135,855 | 1/1979 | Peill | 46/97 R |

*Primary Examiner*—Galen L. Barefoot
*Attorney, Agent, or Firm*—Stephen E. Revis

[57] ABSTRACT

In a hollow airfoil, thin metal baffle sheets are bonded to opposing suction and pressure sides of a longitudinally extending cooling air cavity. The longitudinally extending downstream edges of these opposing baffle sheets are closely spaced apart defining a cooling air outlet slot for the cavity which may, for example, feed cooling air to the trailing edge portion of the airfoil. If the rearward edges of either baffle sheet become unbonded from the inside cavity wall the edge of the baffle sheet might bend inwardly and close the outlet slot. To prevent this possibility a plurality of pedestals extend outwardly from each side of the cavity wall opposite the rearward edge of each baffle sheet and extending substantially to the inwardly facing surface of that baffle sheet trapping it against the wall.

6 Claims, 6 Drawing Figures

FIG. 4
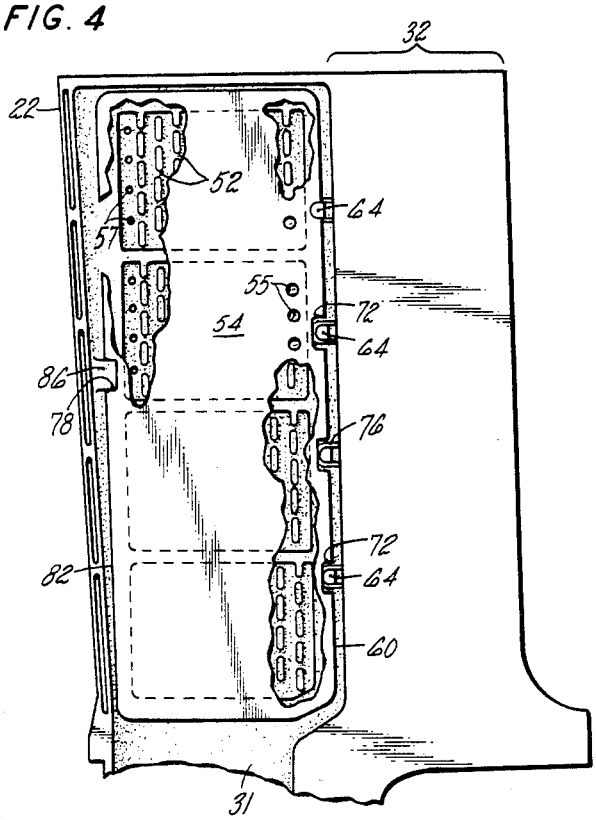
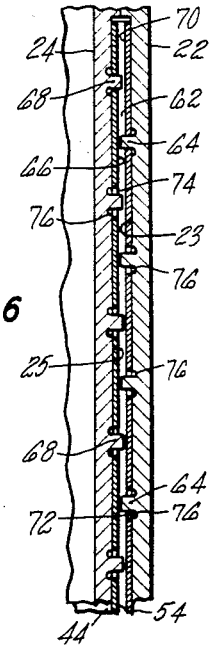
FIG. 6

INTERNALLY COOLED HOLLOW AIRFOIL

The Government has rights in this invention pursuant to Contract No. F33615-79-C-2070 awarded by the Department of the Air Force.

TECHNICAL FIELD

This invention relates to internally cooled hollow airfoils.

BACKGROUND ART

Hollow airfoils are well known in the art. They may be cast as a single structure with internal cooling cavities, or they may be made from a plurality of pieces which are bonded together. For example, it is known to make the airfoil in two pieces: a suction side half and a pressure side half. These halves, when bonded together, may form, for example, one or more longitudinally extending cavities therebetween through which cooling air is passed. A trailing edge portion of the airfoil may include a plurality of pedestals extending across a gap between the pressure and suction side wall to form cooling passageways therethrough. Cooling air from a hereinabove mentioned longitudinal cavity is often directed rearwardly through the trailing edge passageways between the pedestals and exits through slots in the trailing edge of the airfoil.

Tube-like inserts may be disposed within the hereinabove mentioned longitudinal cavities and often have small holes therethrough to direct cooling air from within the tubes against various portions of the airfoil pressure and suction side walls. Also, inserts may be bonded to the inside surfaces of the cavities and be spaced therefrom, such as by ribs or pedestals, to define cooling air passages therebetween. If these inserts come unboned and pull away from the wall they can disrupt the proper flow of cooling air, such as by blocking or closing off other passages within the airfoil. This could cause overheating and failure of the airfoil. Several patents typical of the prior art as discussed above are U.S. Pat. Nos. 3,700,418; 3,554,663; 3,994,622; 4,019,831; 4,022,542; and 4,183,716.

DISCLOSURE OF INVENTION

It is one object of the present invention to ensure that if an insert bonded to the inside wall of an airfoil cavity comes unbonded along an edge, that the unbonded edge remains substantially in its original position so that it does not interfere with the proper flow of cooling air within the airfoil.

Accordingly, an airfoil pressure side wall and suction side wall define a longitudinally extending cooling air cavity therebetween and a trailing edge, portion immediately rearward of the cavity. The airfoil has a first baffle sheet bonded to the inside surface of the suction side wall within the cavity and a second baffle sheet bonded to the inside surface of the pressure side wall within the cavity, the baffle sheets having longitudinally extending rearward edge portions spaced apart from each other defining an outlet from the cavity, the outlet being in communication with an inlet to the trailing edge portion of the airfoils. The airfoil also includes a plurality of pedestals extending outwardly from the inside surface of the suction side wall substantially to the inwardly facing surface of the rearward edge portion of the baffle sheet which is bonded to the opposing pressure side wall, and a plurality of pedestals extending outwardly from the inside surface of the pressure side wall substantially to the inwardly facing surface of the rearward edge portion of the baffle sheet which is bonded to the suction side wall. Thereby, if the rearward edge portions of the baffle sheets become unbonded they are prevented from substantially moving away from the inside wall surfaces; and therefore they cannot close off the outlet from the airfoil cavity to the trailing edge portion of the airfoil.

In a preferred airfoil according to the present invention, the inside surfaces of a longitudinal cavity within the airfoil include channels. The pressure side and suction side baffle sheets are each made from thin metal foil bonded to their respective inside wall surfaces over the channels to define cooling air passageways within the airfoil walls. The longitudinally extending rearward edges of the two baffle sheets together define a longitudinally extending narrow slot which is an outlet for the cooling air within the cavity. The cooling air leaves the cavity through the slot between the rearward edges of the baffle sheets and travels into and through cooling air passages within the trailing edge portion of the airfoil. A plurality of pedestals extend from the inside surfaces of each of the pressure side wall and suction side wall opposite the rearward edge portion of the baffle sheet bonded to the opposing side wall. The rearward edge portion of each baffle sheet is thus trapped between the wall to which it is bonded and the end of the pedestal extending toward it from the opposite wall.

Without the features of the present invention, if the rearward edge of either foil baffle sheet became unbonded from the wall it could fold inwardly and contact the edge of the opposing baffle, thereby substantially closing off the outlet slot from the cooling air cavity which provide cooling air to the trailing edge portion of the airfoil.

The foregoing and other objects, features and advantages of the present invention will become more apparent in the light of the following detailed description of preferred embodiments thereof as shown in the accompanying drawing.

BRIEF DESCRIPTION OF THE DRAWINGS

FIG. 4 is a view taken in the direction of line 4—4 of FIG. 2 with the pressure side of the airfoil removed.

FIG. 6 is a sectional view taken along the line 6—6 of FIG. 5.

BEST MODE FOR CARRYING OUT THE INVENTION

Figure 1:
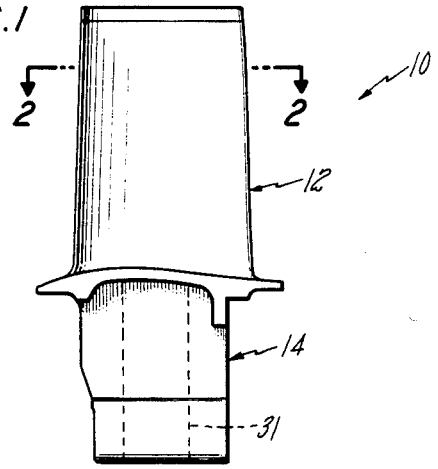
FIG. 1 is a side elevation view of a gas turbine engine turbine blade according to the present invention.

As an exemplary embodiment of the present invention consider the gas turbine engine turbine blade of FIGS. 1–6 and which is generally represented by the reference numeral 10. As shown in FIG. 1, the blade 10 includes an airfoil 12 and a root 14.

Figure 2:
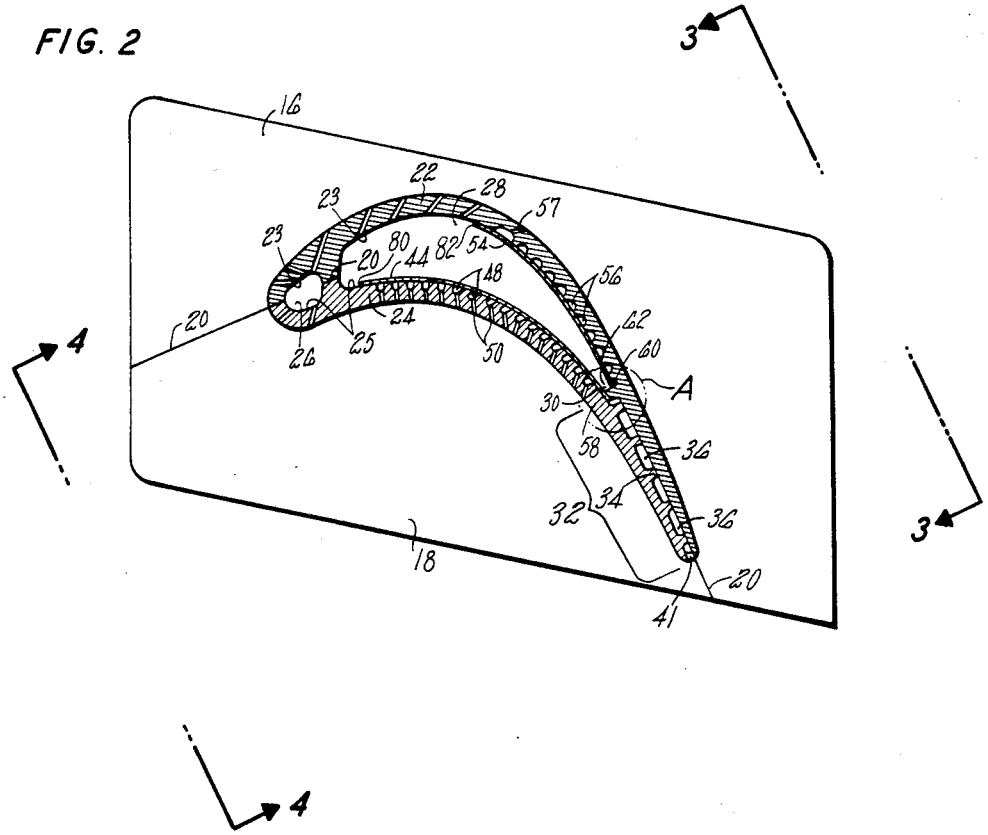
FIG. 2 is an enlarged sectional view taken along the line 2—2 of FIG. 1.

As best shown in FIG. 2, the blade 10 is formed from two halves 16, 18 which fit together and are bonded along a longitudinally extending bond plane 20 which passes through the airfoil 12 in such a way that the blade half 16 includes the suction side wall 22 of the airfoil 12 and the blade half 18 includes the pressure side wall 24 of the airfoil 12. The inside wall surfaces 23, 25 of the suction and pressure side walls 22, 24 define, between them, leading edge cooling air cavities 26 and a longitudinally extending central cooling air cavity 28. The central cavity 28 extends substantially the full length of the airfoil, and has a longitudinally extending rearward end 30. Immediately rearward of the cavity 28 is the trailing edge portion 32 of the airfoil 12. Cooling air enters the blade 10 through the root 14 via a cavity 31 (FIG. 1) which communicates with the central cavity 28.

Figure 3:
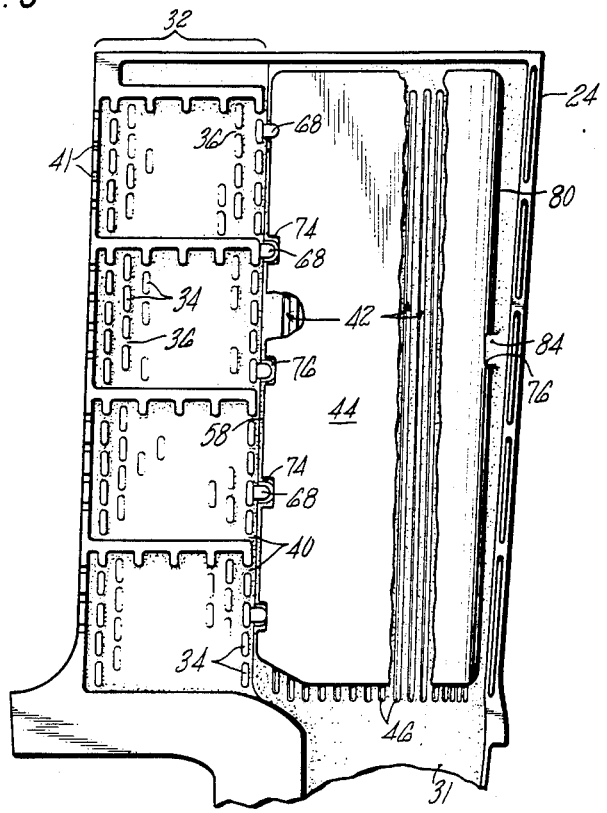
FIG. 3 is a view, taken in the direction of line 3—3 of FIG. 2 with the suction side of the airfoil removed.

Referring to FIGS. 2 and 3, the pressure side wall 24 includes pedestals 34 extending outwardly therefrom into contact with the trailing edge portion 32 of the inside surface 23 of the suction side wall 22 (which is substantially flat), thereby defining a maze of cooling air passageways 36 throughout the trailing edge portion 32. Cooling air inlets 40 to the passageways 36 are defined between adjacent pedestals 34 of the forwardmost longitudinal row of pedestals. These inlets 40 communicate with the rearward end 30 of the cavity 28. One of several longitudinally spaced apart outlets 41 from the downstream ends of the passageways 36 is shown in FIG. 2.

The inside surface 25 of the pressure side wall includes a plurality of longitudinally extending, parallel channels 42. A pressure side foil baffle sheet 44 is bonded to the inside wall surface 25 and covers all but the ends 46 of the channels 42, thereby forming a plurality of parallel cooling air passageways 48 (FIGS. 2 and 5) between the baffle sheet 44 and the pressure side wall 24. Each passageway 48 communicates with air flowing around the outside of the airfoil by means of cooling air holes 50 (FIG. 2) drilled through the pressure side wall 24. During use of the blade 10, cooling air from within the central cavity 28 enters the passageways 42 via the ends 46 of the channels 42, and leaves the airfoil via the holes 50. In like manner channels 52 (FIG. 4) formed in the inside surface 23 of the suction side wall 22 are covered with a suction side foil baffle sheet 54 which is bonded to the inside surface 23 to define maze-like passageways 56 (FIGS. 2 and 5) between the baffle sheet 54 and the suction side wall 22. Cooling air enters the passageways 52 through a plurality of holes 55 through the baffle sheet 54, and is discharged from the passageways 52 via holes 57 through the suction side wall 22. It should be noted that the form of the passageways 48, 56 in the pressure and suction side walls, as well as the manner of bringing cooling air into those passageways and discharging the cooling air from those passageways is not important to the present invention.

The baffle sheets 44, 54 each have a longitudinally extending rearward edge portion 58, 60, respectively, which together define a longitudinally extending cavity outlet slot 62 at the rearward end 30 of the cavity 28 adjacent the inlets 40 to the trailing edge portion cooling air passageways 36. It is apparent that if either of these edge portions 58, 60 become unbonded from their respective surfaces 25, 23 they can bend inwardly toward the opposite side of the airfoil and substantially reduce or even completely cut off the flow of cooling air from the cavity 28 to the trailing edge portion 32. To prevent this from occurring attention is directed to the features of the airfoil 12 best shown in FIGS. 5 and 6.

Figure 5:
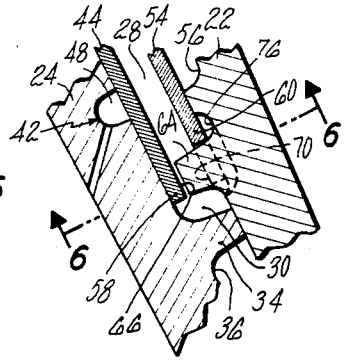
FIG. 5 is a greatly enlarged view of area A of FIG. 2.

FIG. 5 is an enlarged view of a portion of FIG. 2 in the vicinity of the rearward end 30 of the central cavity 28. In accordance with this exemplary embodiment of the present invention, the suction side wall 22 includes a-single longitudinal row of spaced apart pedestals 64 integral therewith. The pedestals 64 extend outwardly from the inside surface 23 substantially to the inwardly facing surface 66 of the rearward edge portion 58 of the baffle sheet 44, thereby effectively preventing that edge of the sheet 44 from moving away from the wall 24 should it become unbonded therefrom. As can be seen in FIGS. 5 and 6 of the drawing, the pedestals 64 are not secured to either the baffle sheet 44 or the pressure side wall. Similarly, although not shown in FIG. 5, a single row of pedestals 68 are integral with the pressure side wall 24 and extend outwardly therefrom substantially to the inwardly facing surface 70 (FIG. 5) of the rearward edge portion 60 of the baffle sheet 54. Thus, the outlet slot 62 will substantially retain its size and shape despite any unbonding of either or both rearward edge portions 58, 60 of the baffle sheets 44, 54, respectively. As can be seen in FIG. 6 of the drawing, the pedestals 68 are not secured to either the baffle sheet 54 or the suction side wall 22.

As best seen in FIGS. 3 and 4, the pedestals 64 pass through cutouts 72 in the rearward edge portion 60 of the baffle sheet 54; and the pedestals 68 pass through cutouts 74 in the rearward edge portion 58 of the baffle sheet 44. Preferably, and as shown in the drawing, one or more of the pedestals 64 and one or more of the pedestals 68 contact the cutouts through which they pass for the purpose of locating the baffle sheets for accurate positioning thereof during bonding of the baffle sheets to the inside surfaces of the airfoil 12. Preferably, the baffle sheets 44, 54 also have cutouts 76 and 78, respectively, in their forward edges 80 and 82, respectively. The cutout 76 in the suction side baffle sheet 44 contacts a pedestal 84 protruding from the inside surface 23 of the suction side wall 22 through the cutout 76. The cutout 78 in the pressure side baffle sheet 54 contacts a pedestal 86 protruding from the inside surface 25 of the pressure side wall 24 through the cutout 78. These forward edge pedestals 84, 86, in conjunction with the rearward edge pedestals 64, 68, trap or fixture the baffle sheets in position during bonding.

To permit the baffle sheets to lie flush against the inside surfaces 23, 25 to which they are to be bonded and to also permit the edges of the cutouts 72, 74 to contact the pedestals 64, 68, respectively (for purposes of positioning), the pedestals 64, 68 are each formed with an undercut 76 (FIGS. 5 and 6) which surrounds the forward 270 or so degrees of each pedestal. (The undercuts 76 eliminate fillets tangent to the surfaces 23, 25 at the bases of the pedestals.) It should also be noted that the word "pedestal" as used throughout the specification and in the claims is intended to encompass within its meaning a protrusion or localized raised portion of any suitable shape and size.

Although the invention has been shown and described with respect to a preferred embodiment thereof, it should be understood by those skilled in the art that other various changes and omissions in the form and detail thereof may be made therein without departing from the spirit and scope of the invention.

I claim:

1. An air foil comprising:

a pressure side wall having an inside surface;

a suction side wall having an inside surface, said pressure and suction side walls defining an external airfoil shape and defining a longitudinally extending cooling air cavity therebetween, said cavity having a longitudinally extending rearward end, said side walls also defining a trailing edge portion immediately rearward of said cavity, said trailing edge portion including means defining cooling air passageways therethrough having inlet means communicating with said rearward end of said cavity;

a first baffle sheet within said cavity bonded to said inside surface of said suction side wall, said first sheet having an inwardly facing surface and a longitudinally extending rearward edge portion at said rearward end of said cavity;

a second baffle sheet within said cavity bonded to said inside surface of said pressure side wall, second sheet having an inwardly facing surface and a longitudinally extending rearward edge portion at said rearward end of said cavity and spaced from said rearward edge portion of said first baffle sheet along the length thereof defining an outlet from said cavity;

a plurality of longitudinally spaced apart first pedestals integral with said suction side wall opposite said rearward edge portion of said second baffle sheet, said first pedestals extending from said inside surface of said suction side wall substantially to said inwardly facing surface of said rearward edge portion of said second baffle sheet and not secured to either said second baffle sheet or said pressure side wall; and a plurality of longitudinally spaced-apart second pedestals integral with said pressure side wall opposite said rearward edge portion of said first baffle sheet, said second pedestals extending from said inside surface of said pressure side wall substantially to said inwardly facing surface of said rearward edge portion of said first baffle sheet and not secured to either said first baffle sheet or said suction side wall;

whereby said first and second pedestals prevent said cavity outlet from closing substantially should either or both of said first and second baffle sheet rearward edge portions come unbonded from their respective side walls.

2. The airfoil according to claim 1 wherein said rearward edge portion of at least one of said baffle sheets includes cutouts, and said pedestals extending to said other of said baffle sheets passes through said cutouts.

3. The airfoil according to claim 2 wherein said rearward edge portion of both of said baffle sheets includes said cutouts.

4. The airfoil according to claim 1 wherein said rearward edge portion of said first baffle sheet includes first cutouts, said first pedestals passing through said first cutouts, wherein said first baffle sheet contacts at least two pedestals at said cutouts which locate said first baffle sheet relative to said suction side wall; and said rearward edge portion of said second baffle sheet includes second cutouts, said second pedestals passing through said second cutouts, wherein said second baffle sheet contacts at least two of said second pedestals at said second cutouts to locate said second baffle sheet relative to said suction side wall.

5. The airfoil according to claim 4 wherein said pressure side wall inside surface and said suction side wall inside surface each have channels therein, and said first baffle sheet covers at least some of said channels in said suction side wall to define cooling air passageways between said first sheet and suction side wall, and said second baffle sheet covers at least some of said channels in said pressure side wall to define cooling air passageways between said second sheet and pressure side wall.

6. The airfoil according to claim 5 wherein said first baffle sheet includes a forward edge portion having a cutout therethrough, and said suction side wall includes a pedestal integral therewith which extends through and contacts said forward edge cutout; and said second baffle sheet includes a forward edge portion having a cutout therethrough, and said pressure side wall includes a pedestal integral therewith which extends through and contacts said forward edge cutout of said second baffle sheet.

* * * * *